US010612496B2

(12) United States Patent
Yang et al.

(10) Patent No.: US 10,612,496 B2
(45) Date of Patent: Apr. 7, 2020

(54) EXHAUST GAS RECIRCULATION COOLING APPARATUS OF ENGINE FOR VEHICLE

(71) Applicants: HYUNDAI MOTOR COMPANY, Seoul (KR); KIA MOTORS CORPORATION, Seoul (KR)

(72) Inventors: Il Suk Yang, Hwaseong-Si (KR); Sung Chan Cho, Seoul (KR); Kyoung Hee Kim, Ansan-Si (KR); Min Kyu Park, Yongin-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 71 days.

(21) Appl. No.: 16/122,372

(22) Filed: Sep. 5, 2018

(65) Prior Publication Data

US 2019/0383243 A1 Dec. 19, 2019

(30) Foreign Application Priority Data

Jun. 15, 2018 (KR) ..... 10-2018-0068856

(51) Int. Cl.
*F02M 26/32* (2016.01)
*F01P 3/20* (2006.01)
(Continued)

(52) U.S. Cl.
CPC ..... *F02M 26/32* (2016.02); *F01P 3/02* (2013.01); *F01P 3/20* (2013.01); *F02M 26/22* (2016.02);
(Continued)

(58) Field of Classification Search
CPC ..... F02M 26/32; F02M 26/22; F02M 26/30; F02M 26/28; F02M 26/29; F01P 3/02; F01P 3/20
See application file for complete search history.

(56) References Cited

U.S. PATENT DOCUMENTS 6,360,702 B1 * 3/2002 Osada ..... F28D 7/0066 123/196 AB
2017/0107952 A1 * 4/2017 Yang ..... F02M 26/12
(Continued)

FOREIGN PATENT DOCUMENTS

JP H07-042628 A 2/1995
JP H10-2256 A 1/1998
(Continued)

*Primary Examiner* — Syed O Hasan
(74) *Attorney, Agent, or Firm* — Morgan, Lewis & Bockius LLP

(57) ABSTRACT

An exhaust gas recirculation (EGR) cooling apparatus of an engine for a vehicle includes: a cylinder block comprising cylinder chambers, a water jacket extending along the cylinder chambers, and a space with inlets and outlets passing through the water jacket so that the cooling water circulates into the space through the inlets and the outlets; an EGR cooler coupled to the cylinder block adjacent the space of the cylinder block to cover the space from one side of the cylinder block, and comprising gas flow paths in the space to circulate exhaust gas through the gas flow paths inside the space; and an insert guide disposed between the plurality of cylinder chambers and the space and blocking flow of the cooling water circulating in the water jacket.

11 Claims, 5 Drawing Sheets

(51) Int. Cl.
*F02M 26/22* (2016.01)
*F02M 26/30* (2016.01)
*F01P 3/02* (2006.01)

(52) U.S. Cl.
CPC ..... *F02M 26/30* (2016.02); *F01P 2003/021* (2013.01)

(56) References Cited

U.S. PATENT DOCUMENTS

| | | | | |
|---|---|---|---|---|
| 2017/0138320 | A1 | 5/2017 | Kim et al. | |
| 2017/0306896 | A1* | 10/2017 | Kim ..... | F02M 26/28 |

FOREIGN PATENT DOCUMENTS

| | | | |
|---|---|---|---|
| JP | 2001-132556 | A | 5/2001 |
| JP | 2001-254648 | A | 9/2001 |
| JP | 2002-235607 | A | 8/2002 |
| JP | 2015-025420 | A | 2/2015 |
| KR | 10-0828832 | B1 | 5/2008 |
| KR | 10-2017-0037003 | A | 4/2017 |
| KR | 10-2017-0046492 | A | 5/2017 |
| KR | 10-2017-0056356 | A | 5/2017 |
| KR | 10-2017-0120246 | A | 10/2017 |

* cited by examiner

EXHAUST GAS RECIRCULATION COOLING APPARATUS OF ENGINE FOR VEHICLE

CROSS-REFERENCE TO RELATED APPLICATION

This application claims the benefit of priority to Korean Patent Application No. 10-2018-0068856, filed on Jun. 15, 2018 in the Korean Intellectual Property Office, the disclosure of which is incorporated herein by reference.

TECHNICAL FIELD

The present disclosure relates to an exhaust gas recirculation (EGR) cooling apparatus of an engine for a vehicle in which an EGR cooler structure is applied to a cylinder block.

BACKGROUND

In general, an exhaust gas recirculation (EGR) cooler applied to a gasoline engine in a vehicle recirculates a part of exhaust gas exhausted through an exhaust manifold and thus improves fuel efficiency and reduces harmful compounds, such as NOx. In order to satisfy vehicle output augmentation and strengthening of exhaust control, application of such an EGR cooler to a gasoline engine exhaust system is gradually increased now.

The EGR cooler is mounted at the outside of a cylinder block or mounted on an outer side of an engine so as to perform cooling operation. However, the conventional EGR cooler has a hose to form a path for transmitting a cooling medium, and such a hose is easily damaged by vibration. Further, together with the hose, additional elements, such as a nipple, are employed and thus the unit costs of the EGR cooler may be raised.

The above description has been provided to aid in understanding of the background of the present disclosure and should not be interpreted as conventional technology known to those skilled in the art.

SUMMARY

The present disclosure has been made in view of the above problems, and it is an object of the present disclosure to provide an exhaust gas recirculation (EGR) cooling apparatus of an engine for a vehicle in which an EGR cooler is provided within a cylinder block so as to reduce a layout and to improve cooling efficiency of the EGR cooler.

In accordance with an exemplary embodiment of the present disclosure, an EGR cooling apparatus of an engine for a vehicle includes: a cylinder block including a plurality of cylinder chambers; a water jacket extended along the cylinder chambers and providing a circulation path of cooling water, and a space provided with inlets and outlets formed through the water jacket so that the cooling water is circulated into the space through the inlets and the outlets; an EGR cooler coupled to the space of the cylinder block so as to close the space and including gas flow paths provided in the space to circulate exhaust gas therethrough; and an insert guide provided between the inlets and the outlets of the water jacket and blocking flow of the cooling water circulated in the water jacket so that the cooling water circulated in the water jacket is circulated into the space through the inlets and the outlets and exchanges heat with the gas flow paths of the EGR cooler.

A supply path to supply the cooling water to the water jacket may be formed in the cylinder block, and the inlets may be located on the circulation path of the water jacket so as to be closer to the supply path than the outlets.

At least one inlet and at least one outlet of the cylinder block may be formed in an arrangement direction of the cylinder chambers, and the insert guide may be located at a point of the water jacket where the at least one inlet and the at least one outlet are divided from each other.

One of the inlets and the outlets of the cylinder block or both of the inlets and the outlets of the cylinder block may be located at an upper region of the space.

The EGR cooler may include a cover to cover the space of the cylinder block and an EGR inlet and an EGR outlet provided at an outer part of the cover so that exhaust gas flows into or is exhausted from the EGR cooler therethrough, the gas flow paths may be extended at the inside of the cover so as to traverse the space, one end of each of the gas flow paths may be connected to the EGR inlet, and the other end of each of the gas flow paths may be connected to the EGR outlet.

The insert guide may include a panel part extended so as to correspond to a shape of the water jacket, having a vertical plane and inserted into the water jacket, and a guide part extended from the panel part in a vertical direction along the cylinder chambers and located between the inlets and the outlets.

Through holes may be formed at positions of the panel part corresponding to the inlets and the outlets of the cylinder block under the condition that the panel part is inserted into the water jacket.

The cylinder chambers may be arranged so as to be connected, and thus, connection points between the cylinder chambers may be concave, and the guide part of the insert guide may be located at one connection point between the cylinder chambers, provided between the inlets and the outlets of the cylinder block.

A blocking part protruding towards outer walls of the cylinder chambers and an inner wall of the cylinder block may be formed at the guide part of the insert guide.

The guide part of the insert guide may be spaced apart from the cylinder chambers by a designated gap so that a part of the cooling water circulated in the water jacket passes through the guide part.

The insert guide may protrude from the cylinder block towards the water jacket and be extended in a vertical direction of the cylinder chambers.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Reference will now be made in detail to the exemplary embodiments of the present disclosure, examples of which are illustrated in the accompanying drawings. Wherever possible, the same reference numbers will be used throughout the drawings to refer to the same or like parts.

Hereinafter, an exhaust gas recirculation (EGR) cooling apparatus of an engine for a vehicle in accordance with one embodiment of the present disclosure will be described.

Figure 1:
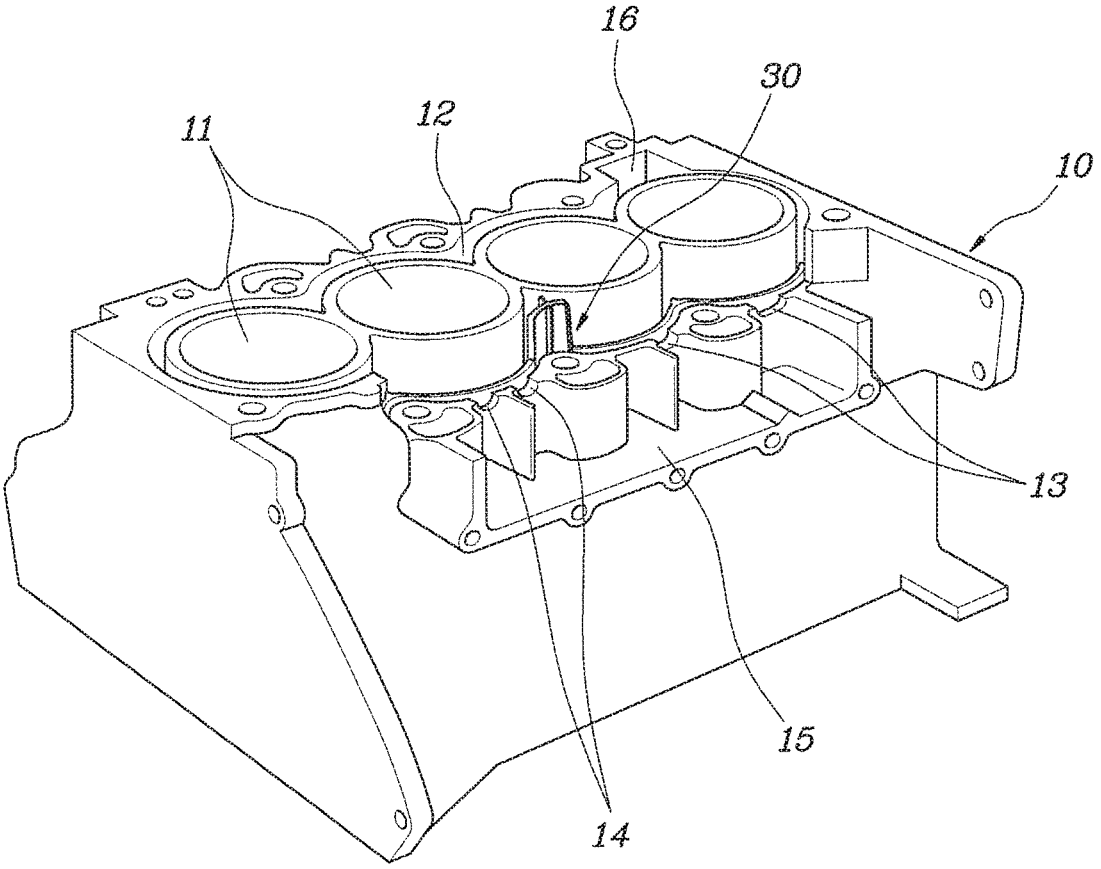
FIG. 1 is a perspective view illustrating an EGR cooling apparatus of an engine for a vehicle in accordance with one embodiment of the present disclosure.
Figure 2:
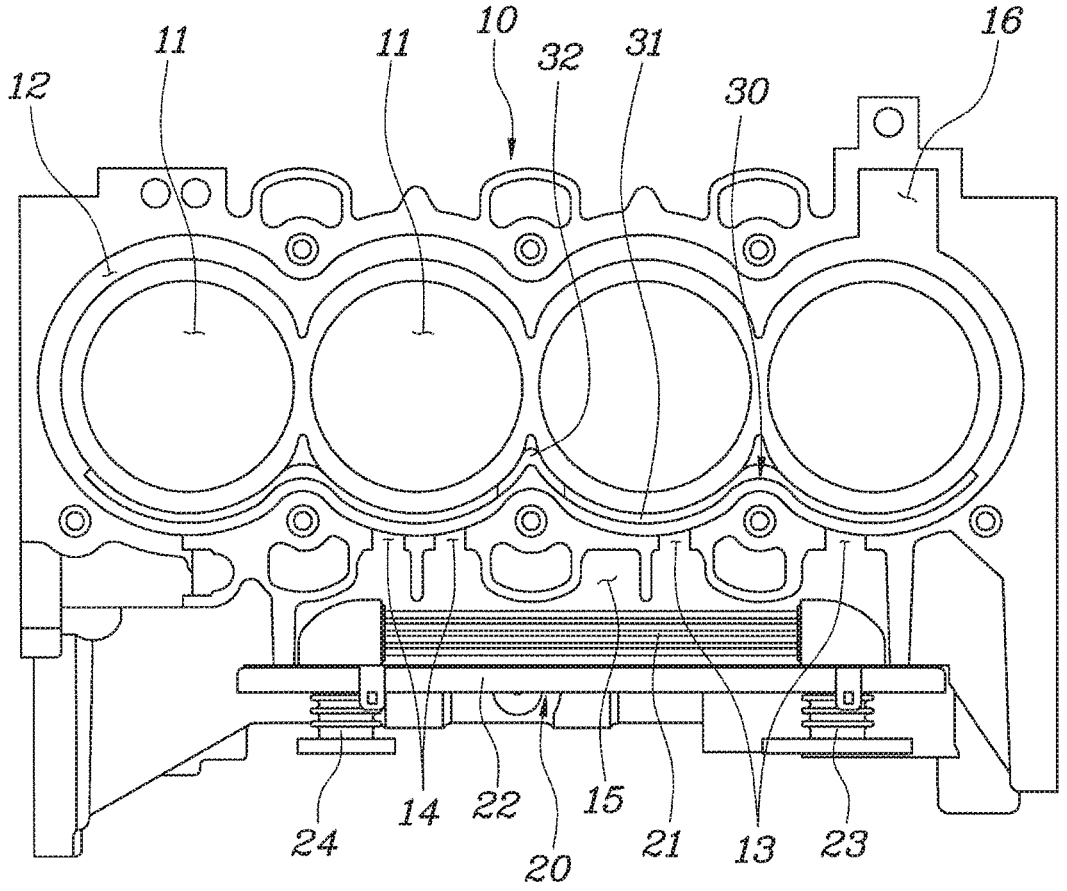
FIG. 2 is a cross-sectional view illustrating the EGR cooling apparatus shown in FIG. 1.

FIG. 1 is a perspective view illustrating an EGR cooling apparatus of an engine for a vehicle in accordance with one embodiment of the present disclosure, FIG. 2 is a cross-sectional view illustrating the EGR cooling apparatus shown in FIG. 1, and FIGS. 3 to 5 are views illustrating the engine for a vehicle shown in FIG. 1.

The EGR cooling apparatus in accordance with the present disclosure includes, as exemplarily shown in FIGS. 1 and 2, a cylinder block 10 including a plurality of cylinder chambers 11, a water jacket 12 extending along the cylinder chambers 1 and providing a circulation path of cooling water and a space 15 provided with inlets 13 and outlets 14 formed through the water jacket 12 so that the cooling water is circulated into the space 15 through the inlets 13 and the outlets 14, an EGR cooler 20 coupled to the space 15 of the cylinder block 10 so as to close the space 15 and including gas flow paths 21, in which exhaust gas is circulated, provided in the space 15, and an insert guide 30 provided between the cylinder chambers 11 and the space 15 and blocking flow of the cooling water circulated in the water jacket 12 so that the cooling water circulated in the water jacket 12 is circulated into the space 15 through the inlets 13 and the outlets 14 and exchanges heat with the gas flow paths 21 of the EGR cooler 20.

The plurality of cylinder chambers 11 are formed in the cylinder block 10, for example, the engine maybe a 4-cylinder engine, as shown in FIGS. 1 and 2. The number of the cylinder chambers 11 may be varied according to specifications of the engine. Further, the space 15 is provided on the outer surface of the cylinder block 10 such that cooling water circulated in the water jacket 12 is circulated into the space 15 through the inlets 13 and the outlets 14.

The EGR cooler 20 is coupled to the space 15 of the cylinder block 10, and when the EGR cooler 12 is coupled to the space 15, the gas flow paths 21 are located within the space 15, and thus, the cooling water circulated in the space 15 may exchange heat with the gas flow paths 21. In more detail, the EGR cooler 20 includes a cover 22 to cover the space 15 of the cylinder block 10 and an EGR inlet 23 and an EGR outlet 24 formed at the outer part of the cover 22 so that exhaust gas may be introduced into or exhausted from the EGR cooler 20 therethrough, and the gas flow paths 21 may be extended at the inside of the cover 22 so as to traverse the space 15 such that one end of each of the gas flow paths 21 are connected to the EGR inlet 23 and the other end of each of the gas flow paths 21 is connected to the EGR outlet 24. Here, the cover 22 may be formed to cover the space 15, and be fixed to the cylinder block 10 by screw engagement. Particularly, since the EGR inlet 23 and the EGR outlet 24 are provided at both ends of the cover 22 and both ends of the gas flow paths 21 are connected to the EGR inlet 23 and the EGR outlet 24, exhaust gas introduced into the space 15 through the EGR inlet 23 may be discharged to the outside through the EGR outlet 24. In such a process, the exhaust gas passes through the gas flow paths 21, and since the gas flow paths 21 is located within the space 15, the recirculated exhaust gas passing through the gas flow paths 21 exchanges heat with cooling water and is thus cooled.

The insert guide 30 is fixed to the inside of the water jacket 12 and serves to switch flow of the cooling water circulated in the water jacket 12. The insert guide 30 may be located between the inlets 13 and the outlets 14 so that the cooling water flowing in the water jacket 12 may flow into the inlets 13, pass through the space 15 and then be discharged from the outlets 14. The insert guide 30 may be formed as a separate insertion and then provided in the water jacket 12, or be formed integrally with the cylinder block 10.

As such, in the present disclosure, the cooling water circulated in the water jacket 12 of the cylinder block 10 is circulated into the space 15 through the inlets 13 and the outlets 14, in addition to cooling of the cylinder chambers 11, and the EGR cooler 20 is coupled to the space 15 so that cooling of exhaust gas is performed through heat exchange between the gas flow paths 21 of the EGR cooler 20 and the cooling water circulated in the space 15. Particularly, the insert guide 30 is provided between the inlets 13 and the outlets 14 of the water jacket 12, and thus, guides the cooling water circulated in the water jacket 12 to the inside of the space 15 through the inlets 13 and then discharges the cooling water from the space 15 through the outlets 14 so as to be circulated into the water jacket 12. That is, by providing the insert guide 30 between the inlets 13 and the outlets 14 of the water jacket 12, the cooling water circulated in the water jacket 12 may be moved to the inlets 13 from the circulation path of the water jacket 12 and the cooling water flowed into the space 15 through the inlets 13 may be discharged to the water jacket 12 through the outlets 14 and thus circulated along the flow in the water jacket 12.

Thereby, the cooling water circulated in the water jacket 12 simultaneously performs cooling of the cylinder chambers 11 and cooling of the gas flow paths 21 of the EGR cooler 20 through circulation into the space 15 by the insert guide 30, and thus, both the cylinder chambers 11 and the gas flow paths 21 of the EGR cooler 20 may be cooled through natural flow of the cooling water.

More specifically, as exemplarily shown in FIG. 2, the cylinder block 10 may comprise a supply path 16, through which cooling water flows into the water jacket 12, and the inlets 13 may be located on the circulation path of the water jacket 12 so as to be closer to the supply path 16 than the outlets 14.

That is, cooling water may flow into the water jacket 12 through the supply path 16 formed in the cylinder block 10, and the cooling water having flowed into the water jacket 12 may be circulated in the water jacket 12 and flow into the inlets 13. Here, since the inlets 13 are located at closer positions to the supply path 16 than the outlets 14, the cooling water having flowed into the water jacket 12 through the supply path 16 may effectively flow into the inlets 13 and flow of the cooling water discharged from the outlets 14 after circulation in the space 15 may be set due to inflow of the cooling water to the inlets 13.

At least one inlet 13 and at least one outlet 14 may be formed according to an arrangement direction of the cylinder chambers 11, and the insert guide 30 may be located at a point of the water jacket 12 where the at least one inlet 13 and the at least one outlet 14 are divided from each other.

The number of the at least one inlet 13 and the number of the at least one outlet 14 may be determined according to a flux of cooling water flowing into the space 15, and in order to secure the flux of the cooling water flowing into the space 15, a plurality of inlets 13 and outlets 14 may be provided. That is, the flux of the cooling water circulated in the space 15 may be determined by increasing the numbers of the inlets 13 and the outlets 14, rather than increasing the widths of the inlets 13 and the outlets 14.

Here, although a plurality of inlets 13 and a plurality of outlets 14 are provided, the insert guide 30 is located at a point of the water jacket 12, where the inlets 13 and the outlets 14 are divided from each other, and thus, flow of cooling water circulated in the water jacket 12 is blocked by the insert guide 30 so that the cooling water may flow into the inlets 13, pass through the space 15 and then be discharged from the outlets 14.

Figure 3:
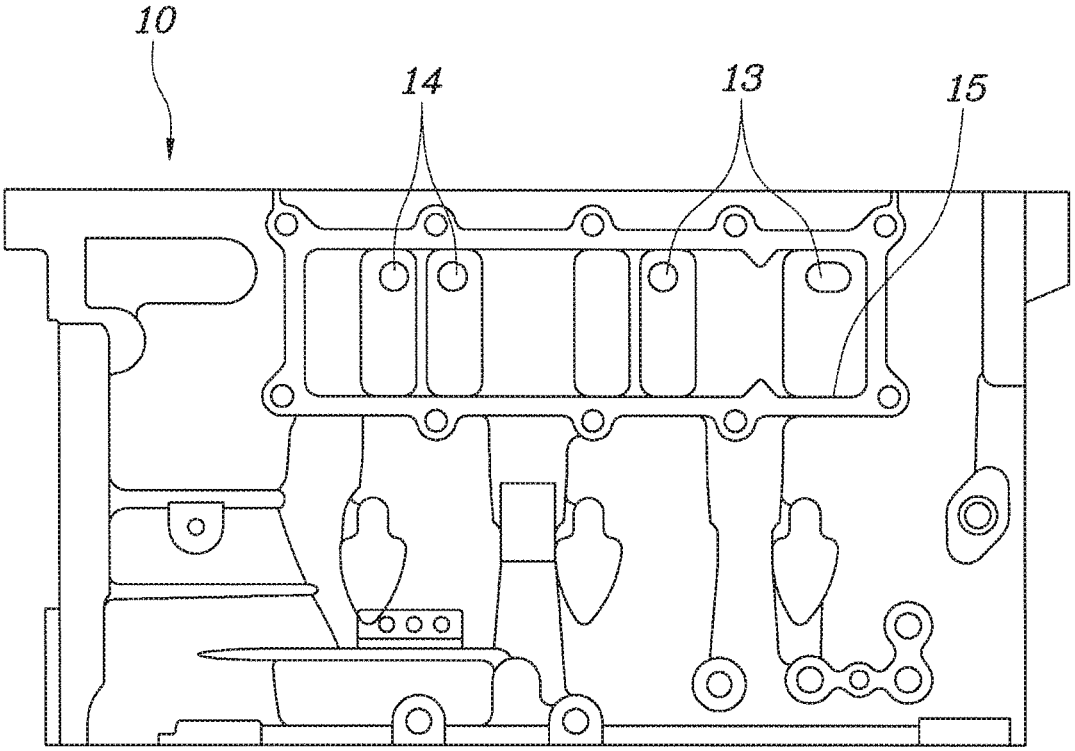
FIGS. 3 to 5 are views illustrating the engine for a vehicle shown in FIG. 1.

Further, as exemplarily shown in FIG. 3, the outlets 14 of the cylinder block 10 or the inlets 13 and the outlets 14 of the cylinder block 10 may be located at an upper region of the space 15.

In a vehicle, during a process of installing an engine or when the engine is installed, air pockets filled with air may be generated in the space 15 due to tilting of the engine at a designated angle. Such air pockets disturb the flow of the cooling water and reduce cooling efficiency, and thus, since the inlets 13 and the outlets 14 are located at the upper region of the space 15, air above the cooling water may be exhausted through the outlets 14 and thereby the air pockets may be removed.

Figure 4:
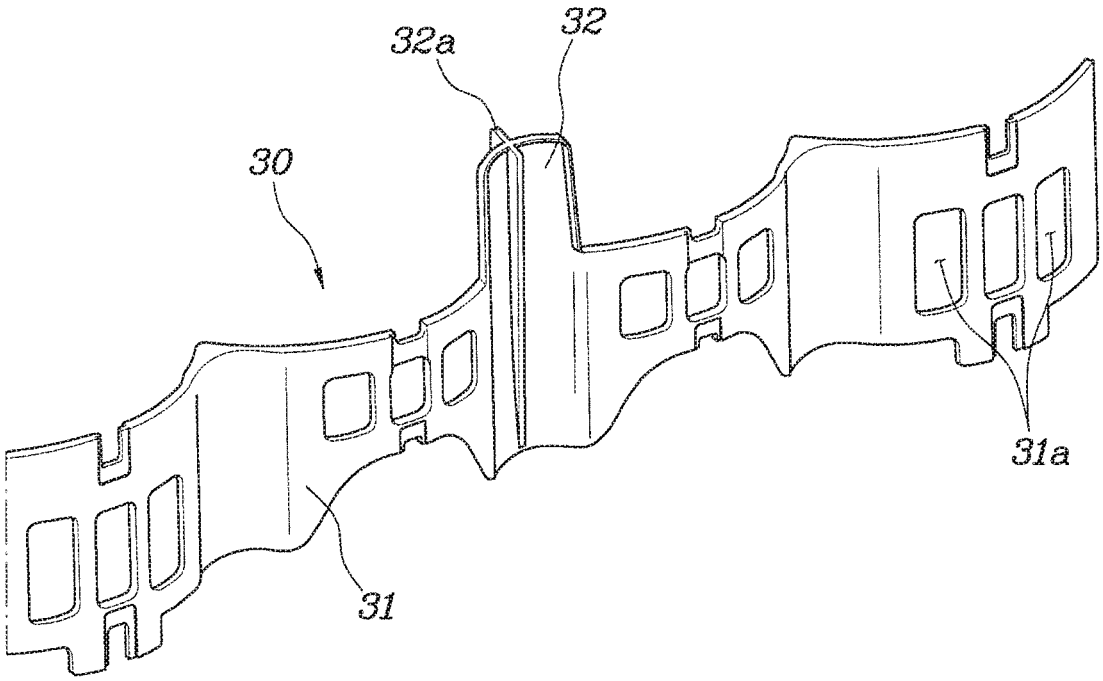

As exemplarily shown in FIG. 4, the insert guide 30 may include a panel part 31 extended so as to correspond to the shape of the water jacket 12, having a vertical plane and inserted into the water jacket 12, and a guide part 32 extended from the panel part 31 in a vertical direction along the cylinder chambers 11 and located between the inlets 13 and the outlets 14.

In the insert guide 30 including the panel part 31 and the guide part 32, the panel part 31 may be formed to correspond to the shape of the water jacket 12 and be bent along the outer circumferential surfaces of the cylinder chambers 11. The panel part 31 has the vertical plane and is received in the water jacket 12 so that the position of the panel part 31 may be fixed, and locking structures are formed at both ends of the panel part 31 so that the position of the panel part 31 may be fixed to the inside of the water jacket 12 through the locking structures. Further, the shape of the upper and lower ends or the vertical plane of the panel part 31 may be determined according to the shape of the cylinder block 10.

The guide part 32 is extended from the panel part 31 in the vertical direction up to the upper end of the cylinder block 10 in a state in which the insert guide 30 is inserted into the water jacket 12, thus guiding the flow of the cooling water circulated in the water jacket 12. Particularly, the guide part 32 located between the inlets 13 and the outlets 14 blocks the flow of the cooling water circulated in the water jacket 12, and thus, the cooling water is guided and circulated into the inlets 13, and the cooling water having flowed into the space 15 of the cylinder block 10 through the inlets 13 exchanges heat with the gas flow paths 21 of the EGR cooler 20, is discharged to the water jacket 12 through the outlets 14 and is then circulated along the circulation path of the water jacket 12.

In more detail, as exemplarily shown in FIG. 4, through holes 31*a* may be formed at positions of the panel part 31 corresponding to the inlets 13 and the outlets 14 of the cylinder block 10 under the condition that the panel part 31 is inserted into the water jacket 12.

The panel part 31 has the vertical plane and may thus close the inlets 13 and the outlets 14 when the panel part 31 is inserted into the water jacket 12. Therefore, the through holes 31*a* are formed at the positions of the panel part 31 corresponding to the inlets 13 and the outlets 14 of the cylinder block 10 under the condition that the panel part 31 is inserted into the water jacket 12. Therefore, the cooling water in the water jacket 12 may pass through the through holes 31*a* and thus be circulated into the space 15 through the inlets 13 and the outlets 14. The through holes 31*a* may have a greater size than that of the inlets 13 and the outlets 14 and the number of the through holes 31*a* may be the same as the total number of the inlets 13 and the outlets 14.

Further, as exemplarily shown in FIGS. 1 and 4, as a plurality of the cylinder chambers 11 is arranged so as to be connected, connection points between the cylinder chambers 11 may be concave, and the guide part 32 of the insert guide 30 may be located at one connection point between the cylinder chambers 11, provided between the inlets 13 and the outlets 14 of the cylinder block 10.

That is, since the cylinder chambers 11 of the engine have a cylindrical shape and are arranged in parallel, the connection points between the cylinder chambers 11 are concave. Thereby, the water jacket 12 is extended so as to be bent along the shapes of the outer circumferential surfaces of the cylinder chambers 11, and the guide part 32 of the insert guide part 30 is located at one concave connection point between the outer circumferential surfaces of the cylinder chambers 11 so that the cooling water circulated in the water jacket 12 may be circulated along the outer circumferential surfaces of the cylinder chambers 11 and thus minimize reduction in cooling efficiency of the cylinder chambers 11.

Figure 5:
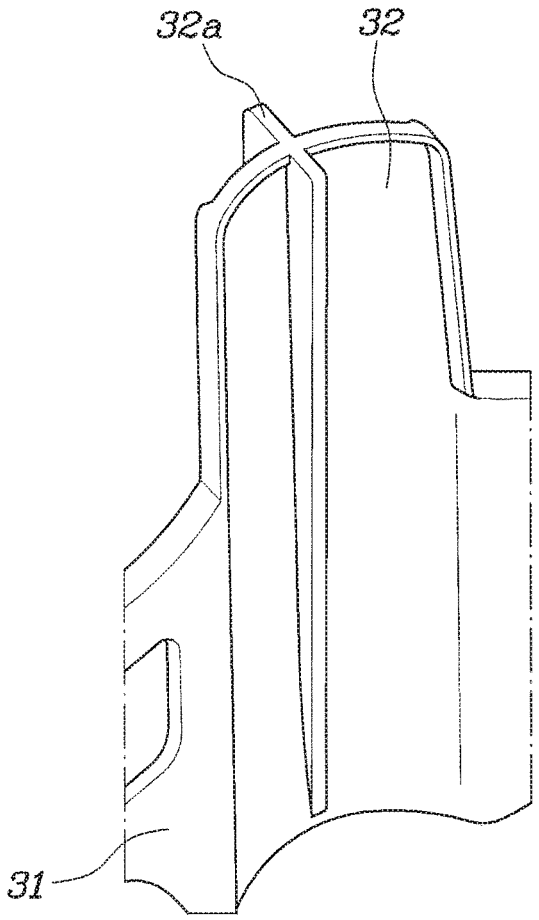

Further, as exemplarily shown in FIGS. 4 and 5, a blocking part 32*a* protruding towards the outer walls of the cylinder chambers 11 and the inner wall of the cylinder block 10 may be formed at the guide part 32 of the insert guide 30.

The water jacket 12 is formed between the outer walls of the cylinder chambers 11 and the inner wall of the cylinder block 10, and the panel part 31 of the insert guide 30 contacts the outer walls of the cylinder chambers 11 and thus prevents heat of a high temperature generated from the cylinder chambers 11 from being excessively emitted, when the panel part 31 is inserted into the water jacket 12. The panel part 31 of the insert guide 30 may be located so as to contact not only the outer walls of the cylinder chambers 11 but also the inner wall of the cylinder block 10, and may be located between the outer walls of the cylinder chambers 11 and the inner wall of the cylinder block 10 so as to guide the flow of the cooling water.

Particularly, the blocking part 32*a* protrudes from the guide part 32, extended from the panel part 31, towards the outer walls of the cylinder chambers 11 and the inner wall of the cylinder block 10, thus blocking the flow of the cooling water circulated in the water jacket 12. Further, as the blocking part 32*a* protrudes from the guide part 32 towards the outer walls of the cylinder chambers 11 and the inner wall of the cylinder block 10, the guide part 32 may have a '+' shape due to the blocking part 32*a*, thus securing rigidity.

The guide part 32 of the insert guide 30 may be spaced apart from the cylinder chambers 11 by a designated gap, and thus, a part of the cooling water circulated in the water jacket 12 may pass through the guide part 32.

That is, the guide part 32 of the insert guide 30 does not completely block the circulation path of the water jacket 12, and as the guide part 32 is spaced apart from the cylinder chambers 11 by the designated gap, a small amount of the cooling water may pass through the guide part 32 and be circulated in the water jacket 12. Thereby, cooling of the cylinder chambers 11 is performed by circulation of the cooling water even in a region where the guide part 32 of the insert guide 30 is formed, and thus, together with circulation of the cooling water into the space 15 by the insert guide 30, cooling of the cylinder chambers 11 even in the region where the guide part 32 of the insert guide 30 is formed is performed and overall cooling efficiency is improved.

The guide part 32 of the insert guide 30 may be spaced apart from the cylinder block 10 by a designated gap so that the cooling water may be circulated along the inner wall of the cylinder block 10, or the guide part 32 of the insert guide 30 may be spaced apart from the cylinder block 10 and the cylinder chambers 11 so that the cooling water may be circulated along the inner wall of the cylinder block 10 and the outer walls of the cylinder chambers 11. The flow of the cooling water may be determined according to the shape of the guide part 32 of the insert guide 30, as such, and be determined according to heat efficiency based on an engine design.

The insert guide 30 may protrude from the cylinder block 10 towards the water jacket 12 and be extended in the vertical direction of the cylinder chambers 11. Since the insert guide 30 protrudes from the cylinder block 10 and is located at the water jacket 12, the insert guide 30 may not be separately provided, and thus, the structure of the EGR cooling apparatus may be simplified.

As described above, in the present disclosure, the EGR cooler 20 is mounted integrally with the cylinder block 10, and cooling water is circulated into the EGR cooler 20 through the inlets 13 and the outlets 14 formed at the cylinder block 10. Particularly, the insert guide 30 guides the flow of the cooling water circulated in the water jacket 12 to the EGR cooler 20 through the inlets 13, and thus, the cooling water circulated in the water jacket 12 may cool both the cylinder chambers 11 and recirculated exhaust gas of the EGR cooler 20.

As such, the EGR cooler 20 is provided in the cylinder block 10 and thus a layout may be reduced, and components of a cooling circuit are omitted and thus manufacturing costs may be reduced and cooling efficiency of the EGR cooler 20 may be improved.

As is apparent from the above description, in an EGR cooling apparatus of an engine for a vehicle in accordance with one embodiment of the present disclosure, an EGR cooler is provided within a cylinder block and thus a layout may be reduced, and components of a cooling circuit are omitted and thus manufacturing costs may be reduced and cooling efficiency of the EGR cooler may be improved.

Although the exemplary embodiments of the present disclosure have been disclosed for illustrative purposes, those skilled in the art will appreciate that various modifications, additions and substitutions are possible, without departing from the scope and spirit of the invention as disclosed in the accompanying claims.

What is claimed is:

1. An exhaust gas recirculation (EGR) cooling apparatus of an engine for a vehicle, comprising:

a cylinder block comprising:

a plurality of cylinder chambers;

a water jacket extending along the plurality of cylinder chambers for a circulation path of cooling water; and a space with inlets and outlets passing through the water jacket so that the cooling water circulates into the space through the inlets and the outlets;

an EGR cooler coupled to the cylinder block adjacent the space of the cylinder block to cover the space from one side of the cylinder block, the EGR cooler comprising gas flow paths in the space to circulate exhaust gas through the gas flow paths inside the space; and an insert guide disposed between the plurality of cylinder chambers and the space, the insert guide blocking flow of the cooling water circulating in the water jacket so that the cooling water circulating in the water jacket flows into the space through the inlets and the outlets and exchanges heat with the gas flow paths of the EGR cooler.

2. The EGR cooling apparatus according to claim 1, wherein:

the cylinder block further comprises a supply path to supply the cooling water to the water jacket; and the inlets communicate with the circulation path of the water jacket and are disposed to be closer to the supply path than the outlets.

3. The EGR cooling apparatus according to claim 1, wherein:

among the inlets and the outlets, at least one inlet and at least one outlet of the cylinder block are arranged longitudinally in an arrangement direction of the plurality of cylinder chambers; and a portion of the insert guide is disposed at a point at which the at least one inlet and the at least one outlet are divided from each other.

4. The EGR cooling apparatus according to claim 1, wherein one of the inlets and the outlets of the cylinder block or both of the inlets and the outlets of the cylinder block are located at an upper region of the space.

5. The EGR cooling apparatus according to claim 1, wherein the EGR cooler comprises:

a cover to cover the space of the cylinder block; and an EGR inlet and an EGR outlet at an outer part of the cover so that exhaust gas flows into or is exhausted from the EGR cooler through the EGR inlet and the EGR outlet, wherein the gas flow paths extend inside the cover to traverse the space, one end of each of the gas flow paths is connected to the EGR inlet and another end of each of the gas flow paths is connected to the EGR outlet.

6. The EGR cooling apparatus according to claim 1, wherein the insert guide comprises:

a panel part extending to correspond to a shape of the water jacket in a vertical plane, wherein the panel part is inserted into the water jacket; and a guide part extending from the panel part in a vertical direction along the plurality of cylinder chambers and disposed between the inlets and the outlets.

7. The EGR cooling apparatus according to claim 6, wherein the panel part includes through holes corresponding to the inlets and the outlets of the cylinder block.

8. The EGR cooling apparatus according to claim 6, wherein:

the plurality of cylinder chambers are connected with each other, and each of connection points between the plurality of cylinder chambers has a concave shape; and the guide part of the insert guide is located at one connection point between the plurality of cylinder chambers to be disposed between the inlets and the outlets of the cylinder block.

9. The EGR cooling apparatus according to claim 6, wherein the guide part includes a blocking part protruding towards outer walls of the plurality of cylinder chambers and an inner wall of the cylinder block.

10. The EGR cooling apparatus according to claim 6, wherein the guide part of the insert guide is spaced apart from the plurality of cylinder chambers so that a part of the cooling water circulated in the water jacket passes through a space between the guide part and the plurality of cylinder chambers.

11. The EGR cooling apparatus according to claim 1, wherein the insert guide protrudes from the cylinder block towards the water jacket and extends in a vertical direction of the plurality of cylinder chambers.

* * * * *